United States Patent [19]

Staufner

[11] 4,142,454

[45] Mar. 6, 1979

[54] MACHINE FOR COUNTING FLAT ARTICLES

[76] Inventor: Helmut Staufner, Alte Schiffahrt 4, D 7300 Esslingen-Mettingen, Fed. Rep. of Germany

[21] Appl. No.: 705,610

[22] Filed: Jul. 15, 1976

[30] Foreign Application Priority Data

Jul. 15, 1975 [DE] Fed. Rep. of Germany ..... 2531486
Nov. 11, 1975 [DE] Fed. Rep. of Germany ..... 2550590
Apr. 28, 1976 [DE] Fed. Rep. of Germany ..... 2618762

[51] Int. Cl.[2] ..... B31B 1/94

[52] U.S. Cl. ..... 93/93 C; 271/12; 271/35; 271/202

[58] Field of Search ..... 93/93 C, 93 R; 271/11, 271/12, 35, 94, 162, 165, 202, 273

[56] References Cited

U.S. PATENT DOCUMENTS

| | | | |
|---|---|---|---|
| 2,852,256 | 9/1958 | Faulls, Jr. et al. | 271/197 |
| 3,025,771 | 3/1962 | Uchida | 93/93 C |
| 3,212,772 | 10/1965 | Ward | 271/35 X |
| 3,945,635 | 3/1976 | Marin | 271/202 |
| 3,981,494 | 9/1976 | Prestegaard | 271/165 X |

FOREIGN PATENT DOCUMENTS

| | | | |
|---|---|---|---|
| 2262381 | 11/1973 | Fed. Rep. of Germany | 93/93 C |

*Primary Examiner*—James F. Coan
*Attorney, Agent, or Firm*—Roylance, Abrams, Berdo & Farley

[57] ABSTRACT

A machine for counting flat articles includes a sequence of conveyor belts driven at successively increasing speeds from input to output. At the input end the articles are stacked and withdrawn from the stack from the bottom. A separator above the conveyor isolates the bodies from each other and spaces them, the spacing being increased by the increasing speed of the conveyors as the articles move toward the output end. The articles are counted by a photocell device or feeler. A receiver arranges the articles in a layered arrangement. In one embodiment the input conveyor belt is inclined and has spaced groups of holes with a suction box below the belt to grip and move the articles in spaced relationship.

13 Claims, 4 Drawing Figures

MACHINE FOR COUNTING FLAT ARTICLES

This invention relates to a machine for automatically counting a flat article.

Generally speaking, it has been previously customary to count flat articles such as books, notebooks, sheets of paper and the like by hand. This is, of course, a very expensive and time consuming process.

An object of the present invention is to provide a machine for separating and counting flat bodies which are supplied to the machines in stacks, the bodies being in the nature of one or more sheets of paper or groups of sheets in the nature of notebooks or the like.

A further object is to provide a flat article counting machine in which the bodies are conveyed and separated from each other and are moved individually and in spaced apart relationship to a counting means and are then deposited in a receiving apparatus.

A further object is to provide a flat article counting machine in which there is provided a tension device extending above the conveyor means to separate for counting bodies from a stack which have substantially the same thickness or small variations in thickness.

Briefly described, the invention includes a machine for separating, conveying and counting a plurality of flat bodies such as books, notebooks or sheets of paper comprising separating means for receiving a stack of flat bodies and for separating the body being removed from the body stacked on top of it to permit removal of the bodies one at a time from the bottom of the stack, conveying means having an end portion extending into and forming the bottom of the separating means for removing bodies from the stack by successively removing the bottom one of said bodies, the conveying means including means for establishing a driving connection between the bodies and the conveying means, means for counting the bodies as they are conveyed by the conveying means, and means for receiving the counted bodies. The separating means can include a stop element disposed above the end portion of the conveying means and having a portion extending parallel to the conveying direction of the conveying means and a portion extending transversely across the conveying means and spaced therefrom, and a belt-shaped tension member extending through the space between the conveying means and the portion extending transversely for contacting bodies to be counted. The conveyor means and the tension member extend in the direction of conveyance beyond the stop element, the apparatus further comprising means for adjusting the tension of the tension member.

In order that the manner in which the foregoing and other objects are attained in accordance with the invention can be understood in detail, particularly advantageous embodiments thereof will be described with reference to the accompanying drawings which form a part of this specification and wherein.

Figure 1:
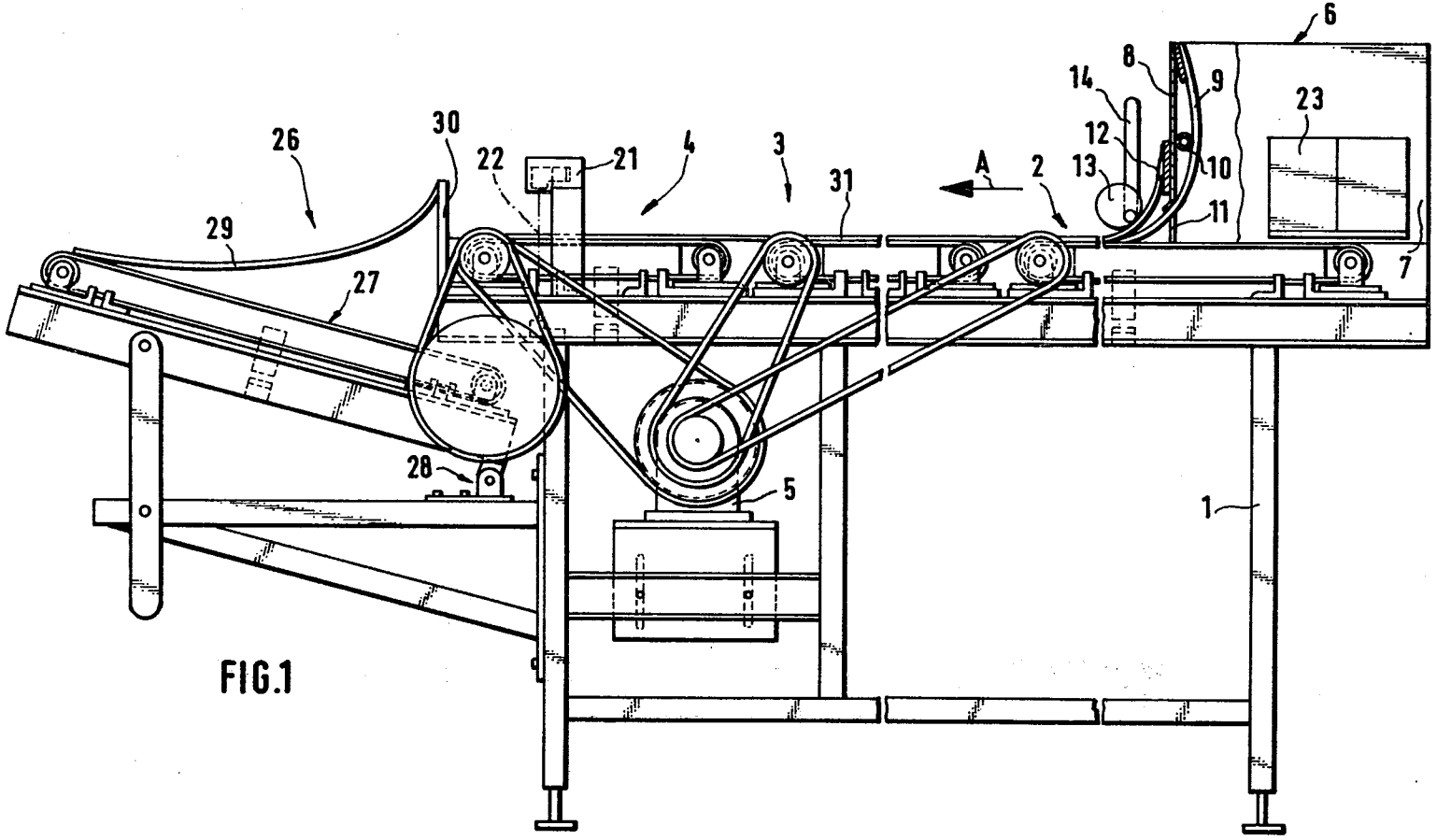
FIG. 1 is a side elevation of a first embodiment of an apparatus in accordance with the invention with certain portions removed for simplicity.
Figure 2:
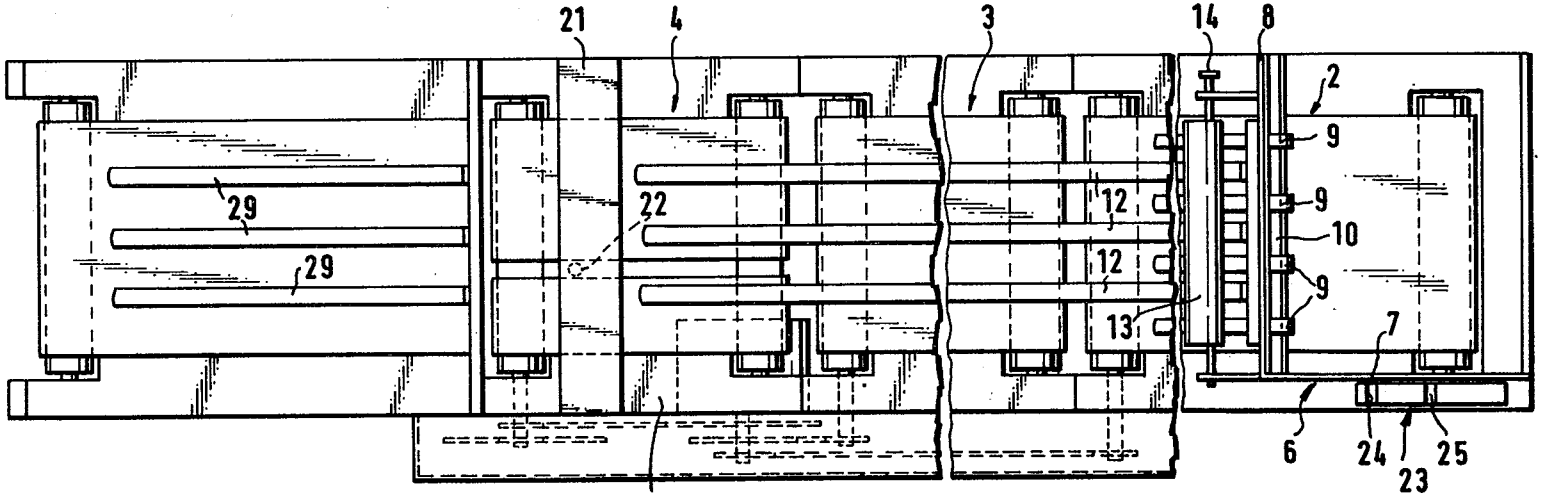
FIG. 2 is a plan view of the apparatus of FIG. 1.

Referring now to FIGS. 1 and 2, it will be seen that the machine includes three belt conveyors 2, 3 and 4 which are mounted on a frame 1 of the machine, the upper surfaces of the belts of the three conveyors lying in substantially the same horizontal plane on reversing rolls in a conventional manner. The three belts are coupled to a drive motor 5 and are driven at different speeds, the speed of belt 4 being greater than 3 and the speed of belt 3 being greater than belt 2. As an example, the conveying speed of belt conveyor 3 can be about 1.6 times the speed of belt 2, and the speed of belt 4 can be about twice the speed of belt 2 which, for example, can be driven at the speed of about 0.8 meters per second. The intervals between adjacent ends of the belt conveyors are very small. The belts of the individual conveyors 2 through 4 can be tightened in a known manner for which purpose their reversing rollers, which are of substantially equal diameter, are disposed on the machine frame 1 so as to be adjustable in the direction of conveyance. The belts of these conveyors are selected to have a good "touch" to them, that is, the surfaces thereof provide good frictional engagement so as to establish a driving connection between the belts and the bodies which are being conveyed, substantially without slippage. As indicated in FIG. 1, the belt conveyors convey articles in the direction of the arrow A. The connection between the conveyors and drive motor 5 as schematically shown in FIGS. 1 and 2, includes drive belts or chains coupled to pulleys of preselected different sizes on the drive shaft of motor 5.

At the input end of belt conveyor 2 an angular retaining or stop element 6 is provided, element 6 having a right angle with a leg or wall portion 7 being attached adjacent the side of belt conveyor 2 and disposed in a direction parallel to the direction of conveyance. A second leg 8 of stop member 6 extends transversely across the upper surface of belt conveyor 2. At the upper portion of leg 8 are four clamping elements 9 which are attached to leg 8 at substantially equally spaced apart distances, elements 9 being spaced from the inner surface of leg 8 by a spacer or spacers 10 at a point approximately at the middle of the height of leg 8. Clamping elements 9 thus curve inwardly from the top of leg 8 and then extend through a space 11 between the upper surface of conveyor 2 and leg 8 in the direction of conveyance. As seen in FIG. 1, the lower portion of leg 8 is bent outwardly at its lower extremity in the direction of belt conveyor 3. The belt-shaped clamping elements 9 can be manufactured in the nature of leaf springs and are spaced apart so as to extend substantially across the full width of belt conveyor 2.

On the side of leg 8 facing away from spacer 10, there are three clamping elements 12 mounted in the spaces between elements 9, elements 12 being manufactured in a manner similar to elements 9. Elements 12 are also spaced apart so as to occupy a substantial portion of the width of the belt conveyor but extend along conveyors 2, 3 and 4. An eccentric roll 13 is mounted near the place of attachment of clamping elements 12 but spaced longitudinally from leg 8 and upwardly above the surface of conveyor belt 2. Roll 13 is rotatably and eccentrically mounted on supports attached to leg 8, roll 13 being disposed so as to extend across clamping elements 9 and 12. Roll 13 can be rotatably adjusted by means of a manually operated lever 14 so as to arbitrarily adjust the tension applied to elements 12. Lever 14 can be adjusted along a scale in various positions, and can be provided with a locking arrangement associated with the lever itself, the locking arrangement being of any conventional type which can be supported on frame 1. Depending upon the rotational position of eccentric roll 13, the clamping elements 12 and to some degree, the elements 9 are pressed toward the belt conveyor 2 with a variable and adjustable pressure. It will be noted that a continuous web in the nature of an apron can be provided in place of the clamping elements 9 and 12, which apron can consist of a plastic or metal foil or a textile foil web.

Belt conveyors 2 through 4 can be covered up by a transparent plate spaced upwardly from the upper surfaces of the conveyor belt to prevent possible turning up on individual sheets of the bodies being conveyed.

On the end of the conveyor system opposite stop member 6, at the output end of conveyor belt 4, a stirrup 21 extends transversely across belt 4 upwardly spaced therefrom by a distance which significantly exceeds the thickness of the thickest article to be conveyed. Stirrup 21 supports one portion of an optical system forming a light barrier 22, the other portion of which can be supported on frame 1 below conveyor belt 4. This optical system is not disclosed in any detail, being a conventional light source and photocell detector wherein the light produced by the source is sensed by the detector so that any interruption of the beam passing therebetween produces an electrical pulse at the output of the detector. In order to permit passage of the light beam from the source to the detector, conveyor belt 4 is made in two parts which are laterally spaced, thereby forming a longitudinal gap between the belt portions to permit passage of the ray of light. Pulses produced by the optical system are counted by a conventional counter 23 which can be mounted in the vicinity of stop element 6. The counter can include a continuous counting mechanism 24 and an adjustable counter mechanism 25 to accumulate a count of the number of articles and to compare that count with a predetermined number, if desired. It will be recognized that, in place of the optical system, a microswitch or similar feeler capable of detecting the passage of articles can be provided.

A receiving arrangement 26 is provided at the output end of belt conveyor 4, apparatus 26 including a belt conveyor 27 which has substantially the same direction of conveyance as do conveyors 2–4 and which is disposed at an angle to the horizontal, rising in the direction of conveyance. Conveyor 27 has the same kind of conveyor belt as conveyors 2–4 and can be tensioned in the same manner. Conveyor 27 is shown being driven by driving motor 5. However, a separate driving motor can also be provided for its operation. The inclination of conveyor 27 can be adjusted arbitrarily, for which purpose a hinge joint 28 disposed between the frame of conveyor 27 and the machine frame 1 is provided. The conveying speed of conveyor 27 amounts to about 0.4 of the conveying speed of conveyor 2.

Above belt conveyor 27 there are belt-shaped clamping elements 29 which are similar in nature to clamping elements 9 and 12. Elements 29 are attached to an upwardly extending support at the end of conveyor 4 and extend, at intervals, across conveyor 27 and curve downwardly and outwardly away from the support point, resting on conveyor 27 only in the vicinity of its upper end. While conveyors 2–4 are disposed in the same plane, a vertical separation exists between the output end of conveyor 4 and the input end of conveyor 27.

A stop rail 31 is provided along the side of belt conveyors 2–4 which can be of a discontinuous or continuous nature. In order to hold the bodies which are being conveyed along conveyors 2–4 against stop rail 31, the belt conveyors 2–4 can be inclined in such a way that the side having stop rail 31 is at a lower level than the opposite side of the belt conveyors, thus permitting gravity to cause the articles to rest against the stop rail as they move along. Alternatively, or in addition to this inclination, a leaf-shaped spring operating in a lateral direction can be disposed along the upper surfaces of conveyors 2–4 to urge articles toward stop rail 31. It is also possible to provide a reading device along stop rail 31 which responds to a predetermined code imprinted or otherwise provided on the bodies which are to be counted. The reading device, operating in conjunction with counter 23, can be connected to an installation for electronic data processing.

In use, a stack of books, notebooks or other flat articles which are to be counted is placed upon the input end of belt conveyor 2 within the area defined by stop element 6. The eccentric roll 13 is adjusted so that only one of the notebooks or books at a time is conveyed by belt conveyor 2. As a result of the differing speeds of conveyors 2–4, a distance is established between the individual books to be counted such that the light barrier or other counting device unequivocally and unambiguously responds to each body and the number of books is therefore counted in counter 23. The articles coming from conveyor 4 are dumped onto conveyor 27 and are there arranged in an overlapping arrangement in the manner of scales. The articles thus arranged can be taken manually from the belt conveyor 27 or they can be transported therefrom to a following belt conveyor, not shown. It will be recognized that a roller conveyor can also be employed.

If it is desired that, after counting a predetermined number of flat articles, a distance is to be provided, then that predetermined number is preset into counter 23. As soon as this number is reached, conveyors 2–4 are stopped for an interval determined by a conventional timer, thereby permitting the establishment of a distance between groups of counted articles in the output or receiving equipment. In this event, it will clearly be desirable to provide a different motor driving conveyor 27 from that driving conveyors 2 through 4.

Whenever books or other flat articles of different thicknesses are to be counted, then the eccentric roll 14 is adjusted correspondingly. It is also possible to count books, notebooks and the like of various formats with the help of this machine.

Figure 3:
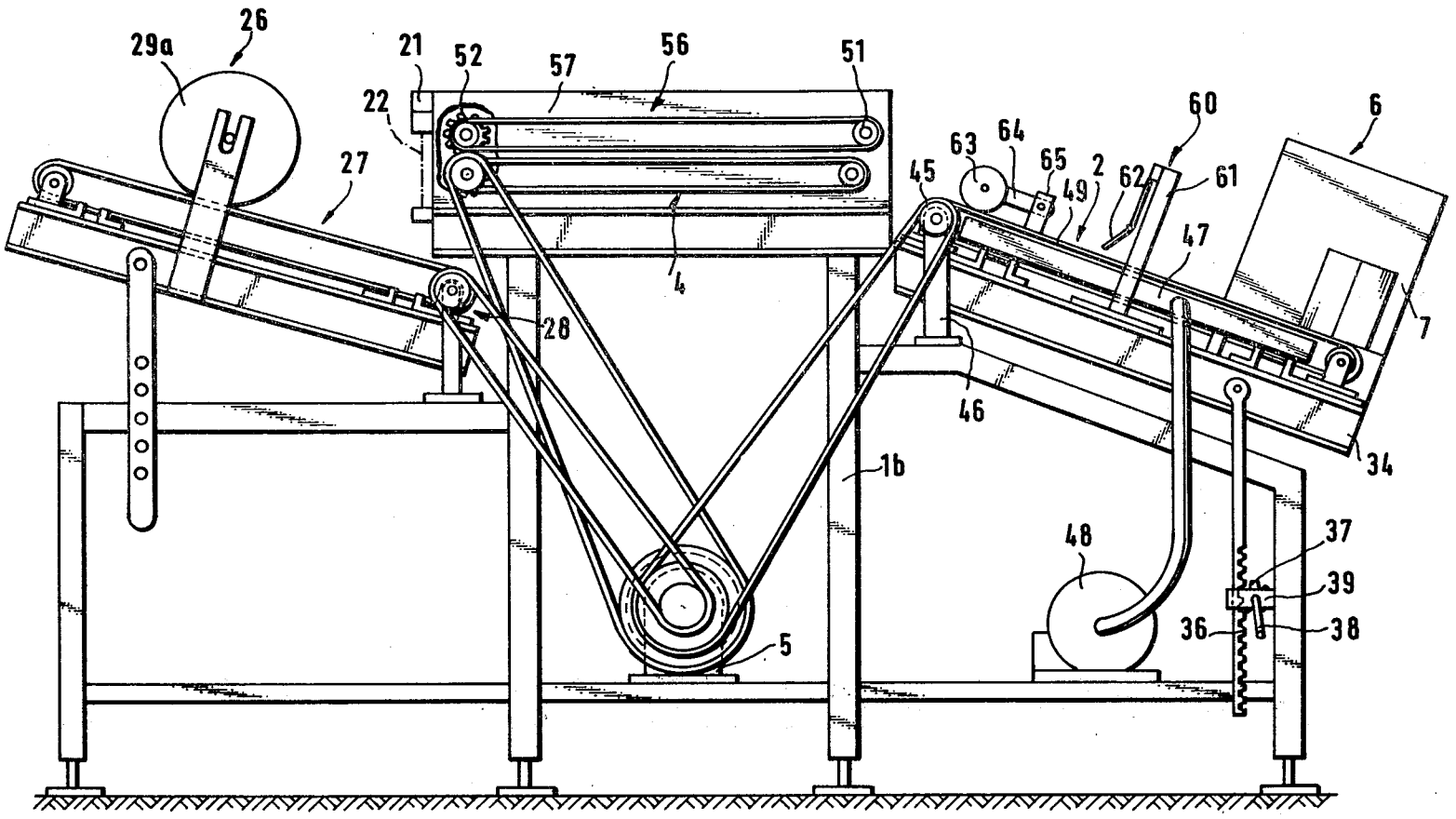
FIG. 3 is a side elevation of a further embodiment of an apparatus in accordance with the invention.
Figure 4:
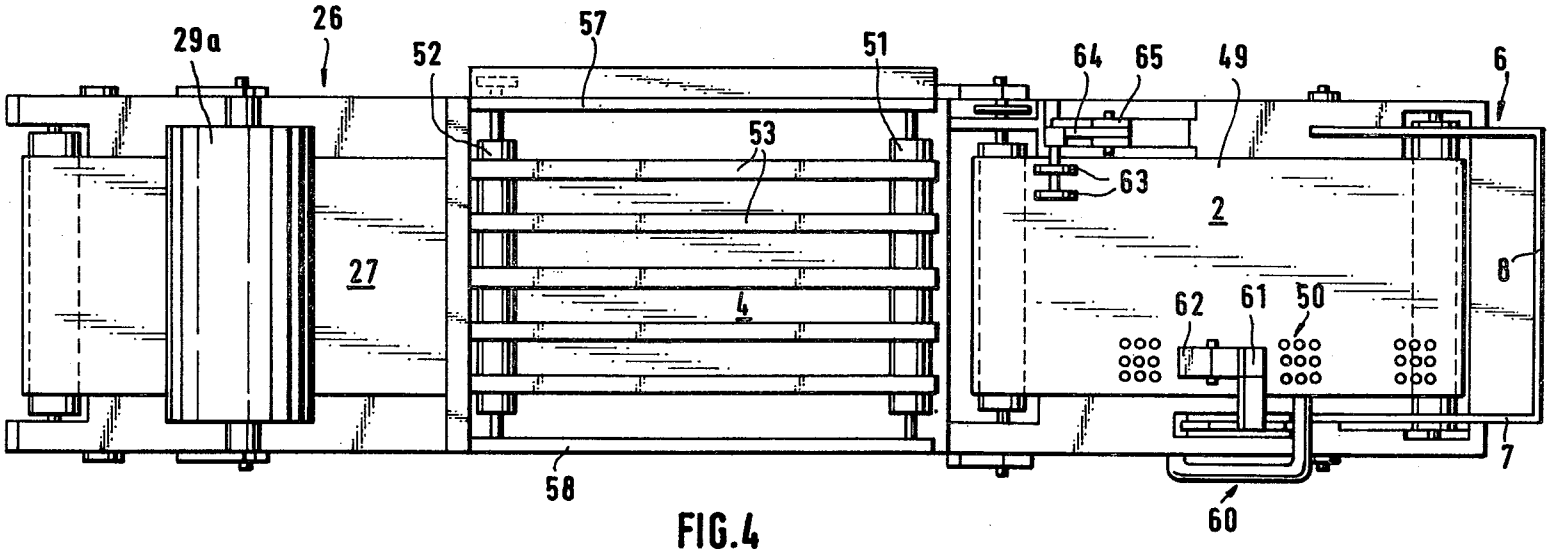
FIG. 4 is a plan view of the apparatus of FIG. 3.

A further embodiment in accordance with the invention is shown in FIGS. 3 and 4. In this embodiment, conveyor 2 is disposed on a frame 34 which is pivotally mounted so that its inclination can be changed by rotating it around the axle of a reversing roll 45 of the belt conveyor. The reversing roll and frame 34 are mounted on a frame 46 which is disposed on machine frame **1*b*. The inclination of frame 34 can be adjusted as needed by means of a rack-and-pinion drive, the toothed rack 36 of which is pivotally attached to frame 34, the teeth thereof being meshed with a pinion gear 37 which is mounted on frame 1*b* and which can be rotated by means of a manually operated crank 58. A guide element 39 which is swivelable around the axle of gear 37 guides the toothed rack 36 and holds it in engagement with gear 37. The shaft can be mounted so that it extends across the width of frame 1*b*, in which case a rack-and-pinion drive can be provided for the gear 37 on each side of frame 1*b*, these being operated by means of the common handcrank 38 with which gears 37**, mounted on a common shaft, can be connected torsionally.

Between the upper and lower portions of conveyor belt 49 of the belt conveyor 2, there is provided a box 47 which is connected to a vacuum pump 48. Box 47 has on its upper surface a plane on which the upper portion of conveyor 49 slides. Belt 49 is provided with groups of holes 50, the groups being spaced apart from each other in the direction of conveyance, these groups of holes being disposed above corresponding elongated holes in the upper surface of box 47. The distances between groups of holes 50 is selected so that one body to be conveyed is held by each group and the next body is held by the next group at a distance from the preceding body.

An angular stop element 6 is disposed at right angles to the upper portion of the input end of belt conveyor 2 above said belt, the stop member having a leg 7 extending along one side of belt conveyor 2 and running parallel to the direction of conveyance. A second leg 8 attached to the end opposite roller 45 extends transversely across the upper portion of the belt conveyor. Parallel to leg 7 an additional leg can be provided on the opposite side of the belt conveyor. Stop element 6 serves for stopping bodies which are to be counted and which are stacked at the input end of the conveyor system, the bodies resting upon portion 8 because of the inclination of the conveyor belt.

In this embodiment, belt conveyor 4 directly follows belt conveyor 2. Above belt conveyor 4 there is a supporting arrangement 56 which is provided so that the lower portion thereof is spaced apart from the upper portion of belt conveyor 4, the spacing being determined by the thickness of the bodies which are to be conveyed. Belt conveyor 56 includes reversing rolls 51 and 52 which are parallel to each other and which extend transversely relative to conveyor 2. This conveyor includes a plurality of belts 53 which are guided around rollers 51 and 52 and are disposed spaced apart with lateral intervals therebetween. Roll 52 can be driven. The belts 53 run in parallel to the belt conveyor 4 and are disposed at such distance from the upper portion of conveyor belt 4 that they contact, at least partially, the upper portions of bodies being conveyed by conveyor 4.

The reversing rolls of belt conveyor 4 and of the stabilizing and supporting arrangement 56 are mounted in bearing plates 57 and 58 which extend upwardly from frame **1*b*** and which are adjustable along the belt conveyor.

A receiving arrangement 26 is series connected with belt conveyor 4 to receive articles conveyed thereby. A hinge arrangement 28 arranged coaxially with respect to the axle of its reversing roller adjacent to conveyor 4 serves for the adjustment of the inclination of belt conveyor 27 in the direction of conveyance.

A roll **29*a* of a larger diameter than the reversing rolls of the conveyors is disposed above conveyor 27. The distance of roll 29*a* from the end of belt conveyor 4 is sufficiently large so that between the end and the roller, the bodies which are being counted can be dumped safely by conveyor 4 onto conveyor 27, the input end of which lies significantly below belt conveyor 4**.

Books, notebooks and the like which are to be counted are stacked resting with the flat side of the bottom article on conveyor belt 49 within stop element 6 in such a way that the cross wall 8 services as a rear stop. The lowest body is engaged by the conveyor belt with the suction provided through a group of holes 50 serving to form the connection between the belt and the bottom article. Thus, one body is seized and extracted and moved along by the conveyor belt alone, one at a time, with the next group of holes engaging the next article. The surface of the conveyor belt in this embodiment is made so that it is smooth and does not frictionally engage the bodies, the suction itself constituting the connection means. The speed of the belt and its smooth surface, in connection with the inclination of the conveyor belt, is such that the bottom article resting directly on conveyor belt 49 is pulled entirely away from under the body lying above it to permit the succeeding body to fall into its place and to then be seized only by the suction acting through the next group of holes 50 in the conveyor belt, thereby establishing a sufficient distance between bodies so that they are counted unambiguously. Establishing a substantial distance between bodies in this way prevents any possibility of adjacent bodies giving rise to a false count by a counting device such as light barrier 22 (FIG. 3) which is provided at the output end of conveyor 4 and which operates in substantially the same manner as described in connection with FIGS. 1 and 2. The bodies conveyed by conveyor 4 are individually dumped onto conveyor 27 and are arranged there in the manner of scales, as previously described. Again, the bodies thus disposed can be manually removed or can be transmitted to a following conveyor.

In order to achieve a positive separation in the case of books, notebooks or the like which have a tendency to stick together, a scraper 60 is provided at a distance from stop element 6 which corresponds to the longest dimension of the books or the like to be counted, which scraper has a stripper 62 extending into the conveying path and attached by means of a joint to a carrying support 61. The stripper is held by means of a spring in its stripping position, inclined slightly in the direction of conveyance, and can be swiveled in that direction by conveyance of the flat articles being carried by the conveyor belt.

Since the groups of holes 50, as shown in FIG. 4, are disposed on the left side of the conveyor belt in the direction of conveyance and because of the variable size of the books and the like which are to be counted, a roll or pair of rolls 63 with rolls disposed at a distance from each other can be provided on the other side, which rolls are mounted on a swiveling arm 64 and which are operable by the conveyor belt 49 in order to avoid any tilting of the books, notebooks or the like. Both the carrying support 61 for the stripper as well as the carrying support 65 for the swiveling arm running in the direction of conveyance are approximately parallel to the conveyor belt. These can be adjusted along the conveyor belt as desired.

While certain advantageous embodiments have been chosen to illustrate the invention, it will be understood by those skilled in the art that various changes and modifications can be made therein without departing from the scope of the invention as defined in the appended claims.

What is claimed is:

1. A machine for separating, conveying and counting a plurality of flat bodies such as books, notebooks or sheets of paper comprising receiving means for receiving a stack of flat bodies and for permitting the body being removed to be separated from the body stacked on top of it to permit removal of said bodies one at a time from the bottom of said stack, conveying means having an inclined end portion extending into and forming the bottom of said receiving means for removing bodies from said stack by successively removing the bottom of one of said bodies, said end portion having a conveyor belt inclined in a direction such that bodies removed from said receiving means are conveyed upwardly and away from the stack;

said receiving means having an end wall for supporting the side of the stack away from the direction of conveyance, said end portion of said conveying means including means for establishing a driving connection between said conveying means and the bodies, one at a time, said means including means defining a plurality of separated groups of holes through said belt, said groups being substantially equally spaced apart, and a vacuum source disposed under said belt and acting through said holes so that said bodies are successively engaged and conveyed away in longitudinally spaced relationship, the engagement of said bodies by the vacuum acting through said holes being the sole active means, operating in combination with said belt, for separating articles from said stack, the spacing between said holes being selected such that said bodies are removed and conveyed in spaced relationship;

means for counting said bodies as they are conveyed by said conveying means; and collecting means for receiving counted bodies.

2. A machine according to claim 1 wherein said separating means includes a stop element disposed above said end portion of said conveying means and having a portion extending parallel to the conveying direction of said conveying means and a portion extending transversely across said conveying means and spaced therefrom; and a belt-shaped tension member extending through the space between said conveying means and said portion extending transversely for contacting bodies to be counted.

3. A machine according to claim 2, wherein said conveyor means and said tension member extend in the direction of conveyance beyond the stop element and further comprising means for adjusting the tension of said tension member.

4. A machine according to claim 3, wherein said means for adjusting includes an adjustable eccentric contacting said tension member.

5. A machine according to claim 4 wherein said means for adjusting includes a hand-operated lever for rotating said eccentric, said lever being fixable in a plurality of positions.

6. A machine according to claim 1 wherein said collector means for receiving counted bodies includes a belt conveyor and a roll resting on the upper surface thereof.

7. A machine according to claim 6 wherein said conveying means includes a plurality of belt conveyors connected in succession, and means for driving each successive belt conveyor in the direction of conveyance faster than the preceding belt conveyor.

8. A machine according to claim 1 and including means for adjusting the inclination of said belt conveyor.

9. A machine according to claim 6 wherein said belt conveyor includes reversing rolls and wherein the diameter of said roll resting on said belt conveyor is substantially greater than the diameters of said reversing rolls.

10. A machine according to claim 1 wherein said receiving means includes an output side opposite said end wall and stripping means for separating adhering bodies, said stripping means being spaced from said output side by a distance corresponding to the longest dimension in the direction of conveyance of bodies to be counted.

11. A machine for separating, conveying and counting a plurality of flat bodies such as books, notebooks or sheets of paper comprising separating means for receiving a stack of flat bodies and for separating the body being removed from the body stacked on top of it to permit removal of said bodies one at a time from the bottom of said stack;

conveying means having an end portion extending into and forming the bottom of said separating means for removing bodies from said stack by successively removing the bottom one of said bodies, said conveying means including means for establishing a driving connection between said bodies and said conveying means, said end portion of said conveying means including a belt conveyor having an inclined conveying surface disposed rising in the direction of conveyance and wherein said separating means includes a stop element for the bodies, arranged at the rear end of said belt conveyor, said bodies being engageable against said stop;

means for counting said bodies as they are conveyed by said conveying means;

means for receiving counted bodies; and means for adjusting the inclination of said belt conveyor, said means for adjusting the inclination including an axle for pivotably supporting one end of said belt conveyor and rack-and-pinion means for changing the elevation of the other end thereof.

12. A machine according to claim 9 wherein said belt conveyor is supported on two reversing rolls, and wherein said axle supports one of said reversing rolls.

13. A machine for separating, conveying and counting a plurality of flat bodies such as books, notebooks or sheets of paper comprising separating means for receiving a stack of flat bodies and for separating the body being removed from the body stacked on top of it to permit removal of said bodies one at a time from the bottom of said stack;

conveying means having an end portion extending into and forming the bottom of said separating means for removing bodies from said stack by successively removing the bottom one of said bodies, said conveying means including means for establishing a driving connection between said bodies and said conveying means, said end portion of said conveying means including a belt conveyor having an inclined conveying surface disposed rising in the direction of conveyance and wherein said separating means includes a stop element for the bodies, arranged at the rear end of said belt conveyor, said bodies being engageable against said stop;

said belt conveyor having a dense, smooth surface with means defining a plurality of groups of holes therethrough, and wherein said means for establishing a driving connection includes a vacuum box under said belt, said groups of holes being disposed adjacent one side of said belt and said machine further including a supporting roll driven by said belt at the other side thereof;

means for counting said bodies as they are conveyed by said conveying means; and means for receiving counted bodies.

* * * * *